United States Patent [19]

Conrad

[11] Patent Number: 5,023,021

[45] Date of Patent: Jun. 11, 1991

[54] CARTRIDGE VENTURI

[76] Inventor: Richard H. Conrad, 950 Idylberry Rd., San Rafael, Calif. 94903

[21] Appl. No.: 489,674

[22] Filed: Mar. 7, 1990

[51] Int. Cl.[5] ..... B01F 3/04

[52] U.S. Cl. ..... 261/76; 261/123; 261/DIG. 75

[58] Field of Search ..... 261/DIG. 75, 76, 123

[56] References Cited

U.S. PATENT DOCUMENTS

| | | | |
|---|---|---|---|
| Re. 21,416 | 4/1940 | Sargent | 261/DIG. 75 |
| 1,526,179 | 2/1925 | Parr et al. | 261/DIG. 75 |
| 1,801,553 | 4/1931 | Heimburger | 261/DIG. 75 |
| 3,282,227 | 11/1966 | Nielson | 261/DIG. 75 |
| 3,446,488 | 5/1969 | Mail et al. | 261/DIG. 75 |
| 4,019,983 | 4/1977 | Mandt | 261/76 |
| 4,101,286 | 7/1978 | Nagao et al. | 261/123 |
| 4,132,838 | 1/1979 | Krener et al. | 261/DIG. 75 |
| 4,534,862 | 8/1985 | Zlokamik | 261/123 |
| 4,766,001 | 8/1988 | Mizandjian et al. | 261/DIG. 75 |
| 4,800,046 | 1/1989 | Malek et al. | 261/DIG. 75 |

*Primary Examiner*—Tim Miles

*Attorney, Agent, or Firm*—Larry D. Johnson

[57] ABSTRACT

A venturi (eductor) cartridge for injecting and dissolving fluids is installed as a removable insert after a tee, and utilizes an axial aspirator tube and thin-sheet radial diffusion for efficient low-turbulence momentum recovery in a very short distance. The venturi minimizes bubble size and bubble recombination to enable maximum solvation, and is particularly suited for use with corrosive fluids. The venturi exits directly into a tank of fluid or into a standard pipeline.

18 Claims, 8 Drawing Sheets

CARTRIDGE VENTURI

BACKGROUND OF THE INVENTION

1. Field of the Invention

This invention relates generally to venturis, eductors, aspirators, injector-mixers, and the like, and more specifically to an improved venturi design for aspirating and dissolving a first fluid into a second fluid.

2. Description of the Prior Art

Numerous venturi designs for aspirating and mixing fluids together are in common use in a wide range of commercial and industrial applications. Venturis operate in accordance with Bernoulli's principle, which states that pressure is inversely proportional to rate of flow. Therefore, to achieve suction or reduced pressure, the flow rate of a motive fluid is increased by funneling the fluid through a narrow venturi throat. An outlet through which an aspirated fluid is injected into the motive fluid is located in the region of lowest pressure (highest velocity) of the throat. Then, for efficient operation, the flow rate of the combined fluids must be reduced to at or near the original rate (thereby recovering momentum) without allowing turbulence or separation of flow from the walls to occur. Any deviation from laminar flow creates vibration and noise, as well as a backpressure which negates part of the suction, thereby requiring more pressure to drive the fluid through the orifice.

Prior art devices have accomplished the necessary reduction in the flow rate by using a diffuser pipe with a relatively long, conically expanding taper. This length can result in several disadvantages:

1. There are many applications where it would be desirable to have a venturi of much shorter overall length due to space considerations.
2. A long venturi must be constructed from a large quantity of material, not only directly due to its length but also because increased length generally necessitates a larger overall diameter to maintain structural strength, and thus more volume or weight of material is required (volume being proportional to the square of the diameter). Since venturis are often used to aspirate and mix very corrosive fluids together, they frequently must be constructed of exotic (and expensive) materials. Many such materials, for example Teflon, have a low structural strength, thereby requiring a proportionally larger diameter and thus an even larger volume of expensive material for the venturi. Stronger inert materials such as Kynar and stainless steel are considerably more expensive and/or more difficult to fabricate into parts than is Teflon.
3. In a long conical diffuser, the stream of aspirated fluid does not always mix well with the motive fluid. Even when it does mix, if for instance the aspirated fluid is a gas and the motive fluid is a liquid, the bubbles are usually not very small, and since they move together down the length of the long conical pipe, the bubbles have ample opportunity to recombine and grow even larger, which they inevitably do. This is often highly undesirable since the generation and maintenance of a very small bubble size is crucial to obtaining efficient solvation of an aspirated gas in a liquid.

Additional problems with prior art venturis (which become more severely problematic when designing for corrosive media) include the following:

4. It is difficult to construct the entrance, throat, and exit portions of the venturi all in one piece (which construction is often desirable for corrosive media).
5. It can be difficult to position the aspirator outlet within the venturi so as to provide symmetrical introduction and therefore optimum distribution of the aspirated fluid, and this becomes even more difficult when the entrance, throat, and exit portions of the venturi are all in one piece.

SUMMARY OF THE INVENTION

The cartridge venturi of this invention provides a device that aspirates and dissolves a first fluid into a second fluid, and is particularly designed to be inserted into a pipeline after a tee or similar fitting. Fluid is aspirated into the motive fluid flow directly from an aspirator tube which is coaxial with the throat of the venturi. A first embodiment of this invention utilizes a thin-sheet radial diffuser, and is usually mounted either into the wall of a tank (or other vessel) or at the end of a pipe extending into a tank, so that it exits directly into the bulk fluid volume of the tank. A second embodiment of this invention utilizes a conical diffuser, and is usually mounted into a pipeline, so that it exits into the pipe in which it is mounted.

The radial diffuser embodiment of this invention is generally composed of four basic components (not including a tee or other pipe fitting and a small tube feed-through fitting upstream of the cartridge venturi):

1. the one-piece cylindrical cartridge body containing the entrance cone, the venturi throat, and the rear surface which defines the first side of a thin-sheet diffusion volume, with an optional short expansion cone between the venturi throat and the thin-sheet volume, and an optional concave radius at the outer edge of the rear surface which directs the exiting flow;
2. the radial diffuser or end piece;
3. the straight axial aspirator tube (with a symmetrical outlet centered coaxially in the motive flow through the venturi throat); and
4. the aspirator tube support.

The conical diffuser embodiment of this invention is similar to the radial diffuser embodiment except that since it is designed to exit into a standard pipeline its cartridge body is terminated with an elongated expansion cone instead of a short expansion cone with a separate end piece.

Because the present invention is inserted as a cartridge, it does not have to be self-supporting. Therefore, it does not need thick walls, and requires only a minimum amount of material which can be selected without undue consideration of its softness or strength. Whereas prior art venturis have an outside diameter which is typically 1.5 times the pipe inside diameter, both embodiments of the present invention have an outside diameter which is slightly less than the pipe inside diameter. This difference can cut fabrication material usage in half. In the radial diffuser embodiment, an additional factor that contributes to compactness and further decreases the quantity of material required is that instead of using a long conical diffuser for laminar momentum recovery, the axial flow exiting out of the venturi throat is directed into a radially flowing thin sheet. The cross-sectional area increases as the sheet expands radially outward, shortening the axial flow passage length required for a given reduction in fluid velocity by a factor of approximately four. This design provides the same suction efficiency as prior art venturi devices, but occupies less space, uses far less material and has a smoother, quieter, more stable flow because the flow is constrained to be laminar in the narrow gap between two walls.

A further attribute of the radial diffuser embodiment relates to the size of the bubbles generated when a gas is the aspirated fluid. Bubble size is smaller than with a conical diffuser because the radial design divides the flow more and more as it spreads outward radially. Since the flow is in the form of a thin sheet spreading out over 360 degrees, there is far less bubble recombination and growth in the diffuser itself than in the conical expansion area of prior art venturis. Furthermore, since the flow leaves the diffuser radially into a large tank volume rather than axially down a pipe as in the prior art, there is less opportunity for bubble recombination downstream.

Because the venturi of this invention is in the form of a cartridge, it is easy to try the effect of various venturi orifices by removing one cartridge from the venturi assembly and inserting another. This is a great advantage because often one does not know in advance what the most efficient orifice size will be, and in the prior art one has to obtain and try a number of complete venturis to find the optimum. It is sometimes necessary to make adjustments in venturi orifice size for different combinations or requirements of water flow rate, back pressure, suction flow and vacuum. In addition, it is very easy to remove the cartridge venturi for inspection or for cleaning.

Both embodiments of the present invention are well suited for aspirating corrosive fluids, with the radial diffuser embodiment being especially adapted for aspirating and dissolving corrosive gases of low solubility such as ozone as used in water treatment applications. This feature is important in that not only is ozone itself highly reactive to many venturi fabrication materials, but nitrogen oxide by-products in the ozone form corrosive nitric acid when they contact moisture. Because of its ability to produce a very fine mist of bubbles, the radial diffuser embodiment is also ideal as an aerator for use in other water treatment applications, including in fisheries to replace air compressors (which require regular maintenance) and airstones (which tend to clog). It can also be used to simultaneously aspirate a fluid, mix it with a motive fluid, and spray the resulting solution or aerated liquid into the open air (or into a gas-filled vessel) over a wide area as a thin radial sheet.

Thus the present invention is very simple in construction. It uses a minimum of fabrication material, thereby enabling the use of expensive chemically inert plastics such as Teflon without regard to their lack of strength, and it is easy and low in cost to fabricate and assemble. The cartridge is quickly insertable, removable and interchangeable. It is easily installed directly into a volume of fluid such as a tank. Its operation is low in turbulence and noise and is free of vibration. It takes up only a very short length of space, creates much finer bubbles than prior art devices, and provides a more complete dissolution of the aspirated fluid into the motive fluid than prior devices.

BRIEF DESCRIPTION OF THE DRAWINGS

FIG. 4*a*–4*d* illustrate various other types of aspirator tube supports suitable for use with the cartridge venturi of this invention, and the aspirator tubes they may be used with;

FIG. 8*a* shows the radial diffuser as installed into the wall of a tank;

FIG. 8*b* shows the radial diffuser as installed into the bottom of a tank;

FIG. 8*c* shows the radial diffuser as installed at the end of a pipe extending into a tank from above; and FIG. 8*d* shows the radial diffuser as installed at the end of a pipe and spraying out into the open air;

DETAILED DESCRIPTION OF A PREFERRED EMBODIMENT

Figure 1A:
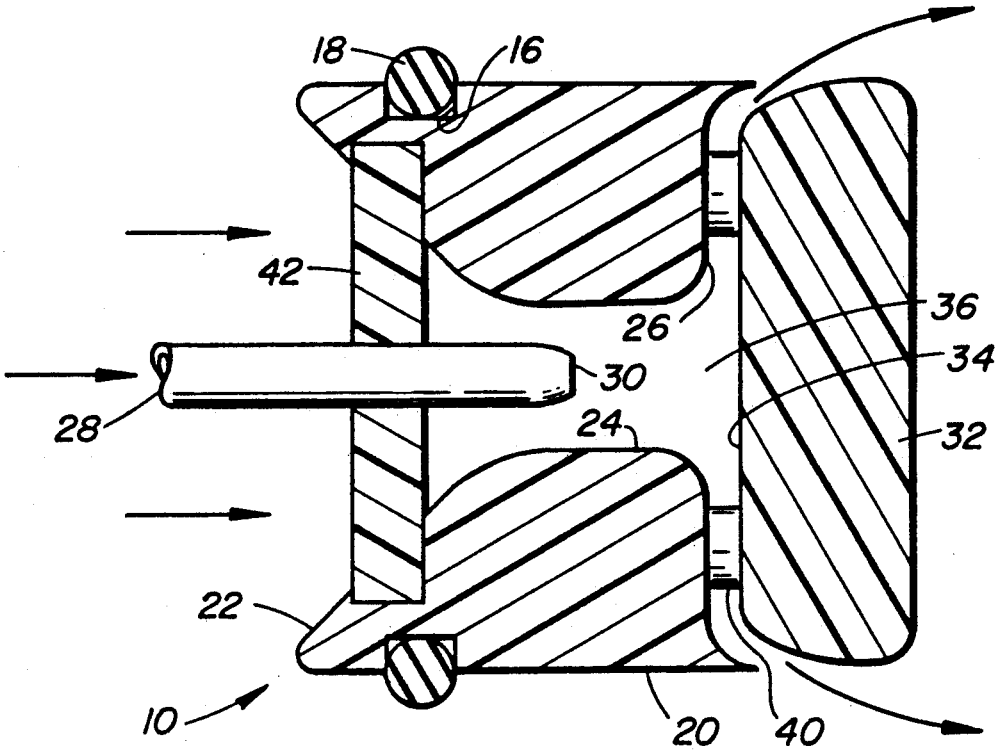
FIG. 1*a* is side elevation cross-sectional view of a radial diffuser embodiment of the cartridge venturi of this invention, illustrating an aspirator tube, an aspirator tube support, a cartridge body bearing an entrance cone portion, a throat portion, a rear surface and exit edge, and an end piece bearing a front surface.
Figure 1C:
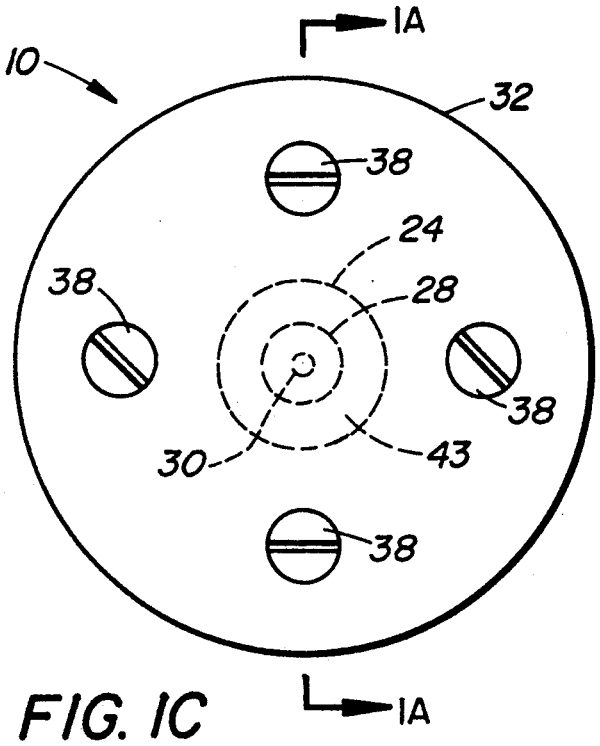
FIG. 1*c* is an end elevation view of the radial diffuser cartridge venturi of FIG. 1*a*, illustrating the back side of the end piece, with the respectively smaller diameters of the venturi throat, aspirator tube, and aspirator tube outlet shown in phantom lines.
Figure 1B:
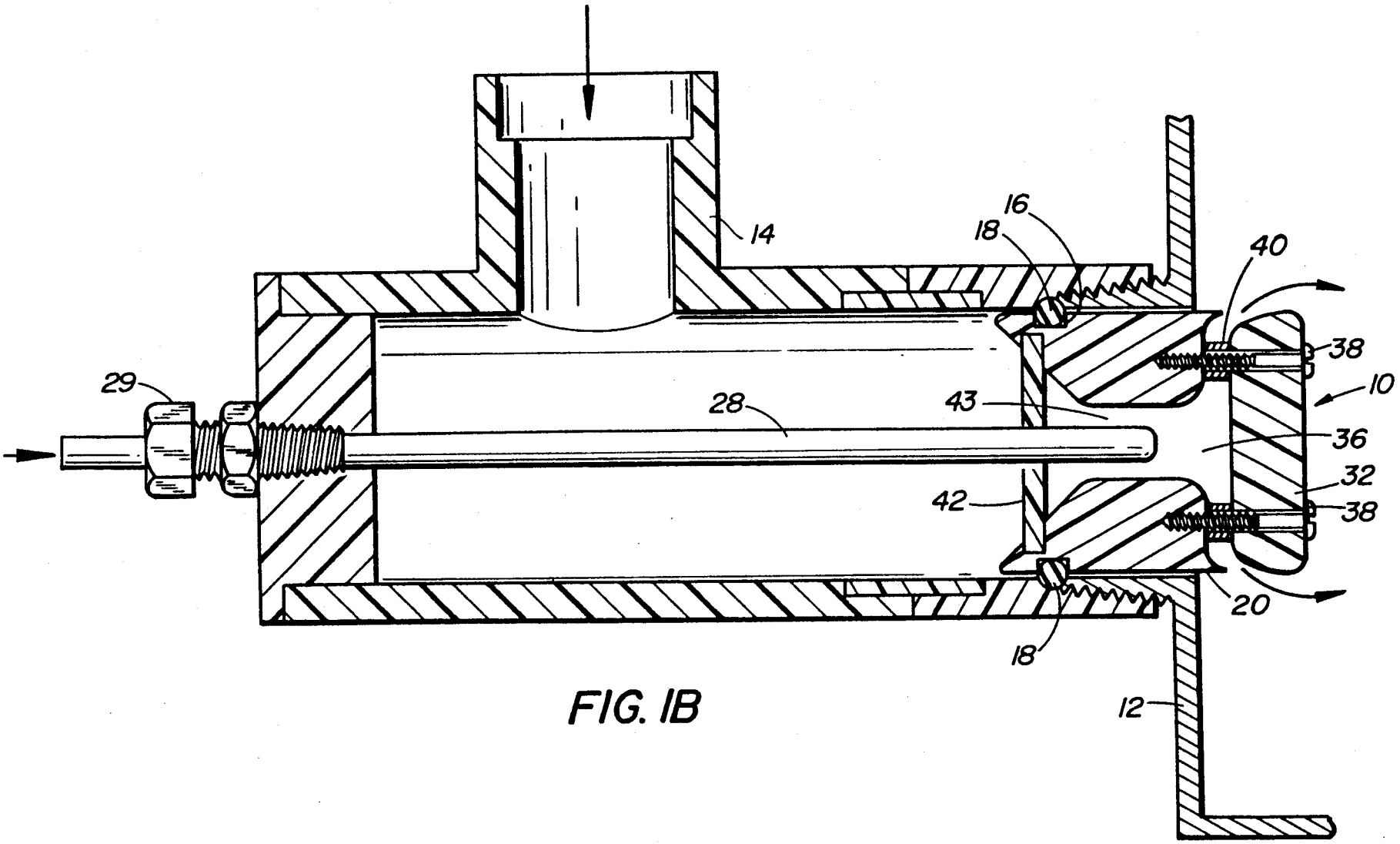
FIG. 1*b* is a side elevation cross-sectional view of the radial diffuser cartridge venturi of FIG. 1*a* as installed into the wall of a tank after a tee pipe fitting.

FIG. 1*a* is a side elevation cross-sectional view of a radial diffuser embodiment 10 of the cartridge venturi of this invention, while FIG. 1*b* is a view of that embodiment installed into the wall of a tank or vessel 12. The cartridge venturi 10 is installed downstream from a tee fitting 14 which can be a standard tee pipe fitting. The cartridge venturi includes a retaining means 16 which can be, for example, a circumferential groove containing an 0-ring or other seal 18. With reference to FIG. 1*b*, the motive fluid enters the assembly at an angle through the side arm of the tee, and flows towards the cartridge venturi 10.

The first major component of the cartridge venturi is the cartridge body 20 which has the external shape of a short cylinder. The body includes retaining means 16, an entrance cone 22 to funnel and accelerate the fluid into the venturi throat, the venturi throat 24, and a rear surface 26 which forms the first surface of a momentum recovery (decceleration) volume.

The second major component of the cartridge venturi is the straight aspirator tube 28 which enters the assembly through a small (standard) tube fitting 29 in the tee and extends coaxially down the hollow center of the cartridge body 20. The aspirator tube transports the fluid to be injected from outside of the tee to an opening 30 in the tube situated in the venturi throat at or near the tube's terminal end. Thus the aspirated fluid moves through the aspirator tube coaxially with the motive flow that moves through the throat.

The third major component of the radial diffuser embodiment is the end piece 32 whose front surface 34, together with the rear surface 26 on the rear side of the cylindrical cartridge body 20, forms the boundaries of a decceleration chamber 36 having the shape of a thin disc. End piece 32 may be attached to cartridge body 20 by screws 38 or other fastening means, and may also include spacers 40.

The fourth major component of the cartridge venturi is an aspirator tube support 42. This support serves to align and stabilize the aspirator tube proximate outlet 30. Support 42 may be in the form of a web or strut fixed within the cartridge body, as illustrated, or may take some other form, as described infra.

FIG. 1*c* is an end elevation view of the radial diffuser cartridge venturi 10 of FIG. 1*a*, illustrating the back side of the end piece 32, with the respectively smaller diameters of the venturi throat 24, aspirator tube 28, and aspirator tube outlet 30 shown in phantom lines. This view illustrates that the motive fluid is constrained to flow within the annular area 43 between venturi throat 24 and aspirator tube 28.

Figure 2A:
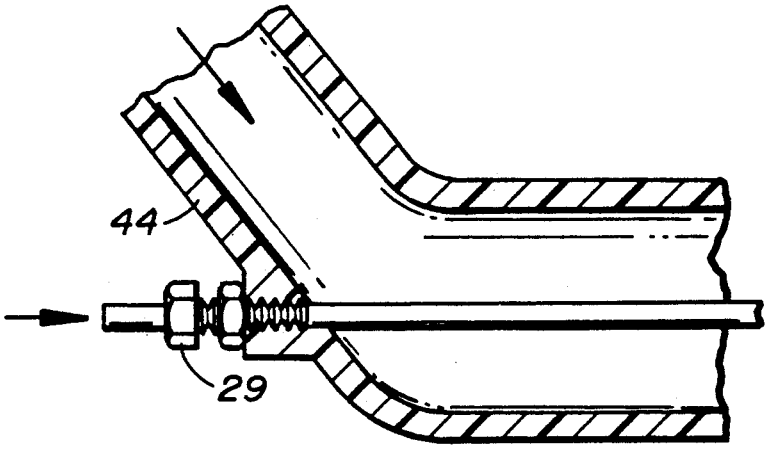
FIGS. 2*a*–2*c* illustrate various other types of tee pipe fittings suitable for use with the cartridge venturi of this invention.
Figure 2B:
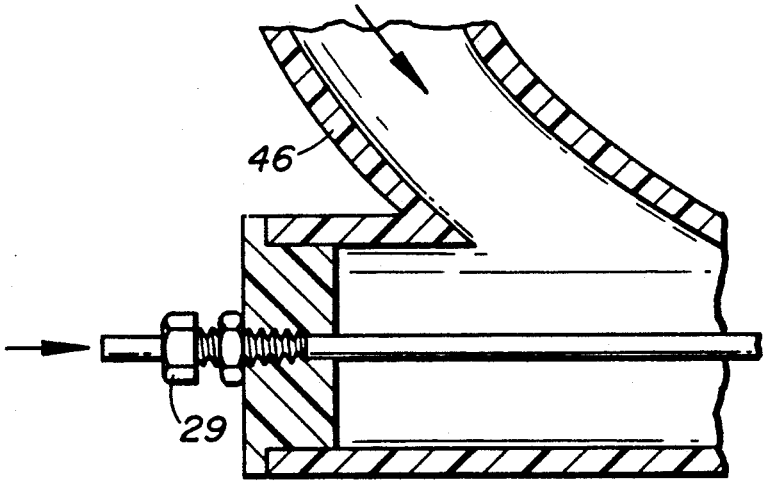
Figure 2C:
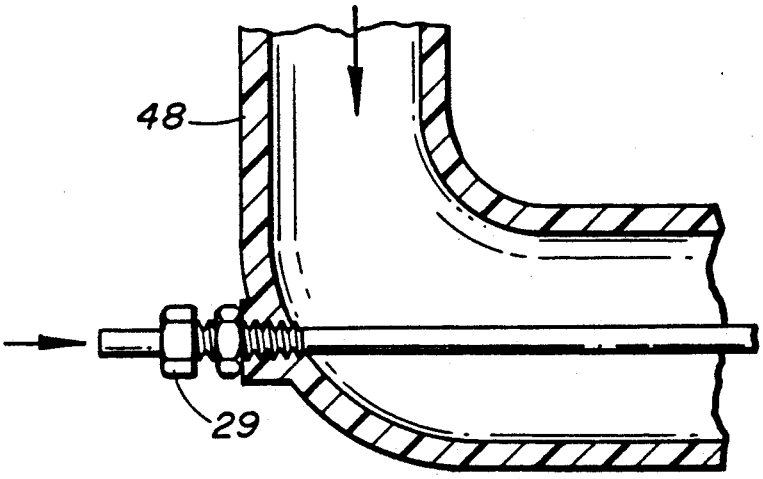

FIGS. 2*a*–2*c* illustrate various other types of tee pipe fittings suitable for use with the cartridge venturi of this invention. For example, FIG. 2*a* illustrates a forty-five degree curved pipe 44 with fitting 29 installed proximate its apex; FIG. 2*b* illustrates a curved tee (cleanout type) fitting 46 with fitting 29 installed in the linear section; and FIG. 2*c* illustrates a ninety degree curved pipe 48 with fitting 29 installed proximate its apex. Any of these fittings, or variations thereof, can be used to accommodate the cartridge venturi and its aspirator tube.

Figure 3D:
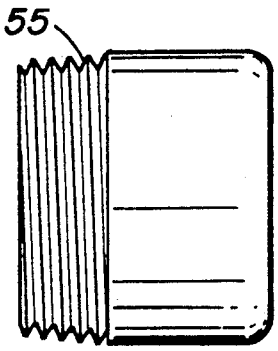
FIGS. 3*a*–3*d* illustrate various types of cartridge body retainers suitable for use with the cartridge venturi of this invention.
Figure 3A:
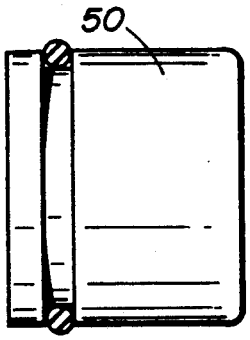
Figure 3B:
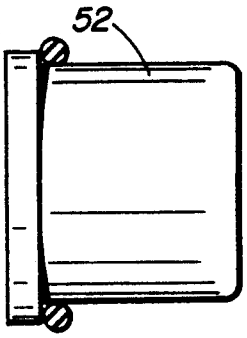
Figure 3C:
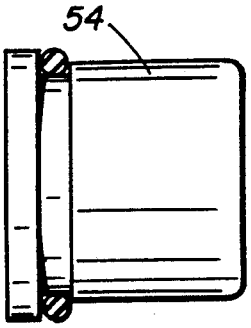

FIGS. 3*a*–3*d* illustrate various types of cartridge body retainers suitable for use with the cartridge venturi of this invention. For example, FIG. 3*a* illustrates a cartridge body 50 bearing a circumferential groove, FIG. 3*b* illustrates a cartridge body 52 bearing a circumferential flange, and FIG. 3*c* illustrates a cartridge body 54 bearing both a circumferential groove and circumferential flange. FIG. 3*d* illustrates a further variation, that of a threaded cartridge body 55 conditioned for engagement to standard pipe threads on a tank fitting or pipeline.

Figure 4D:
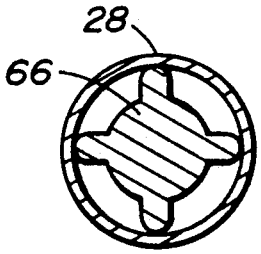
Figure 4A:
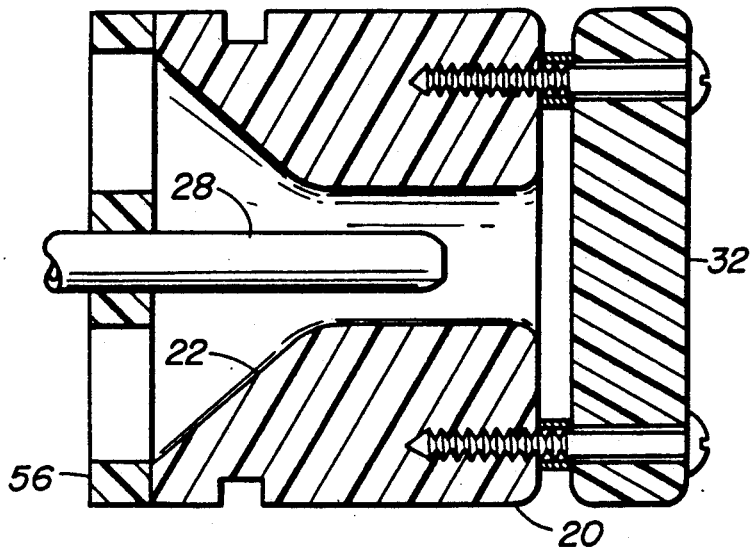
Figure 4B:
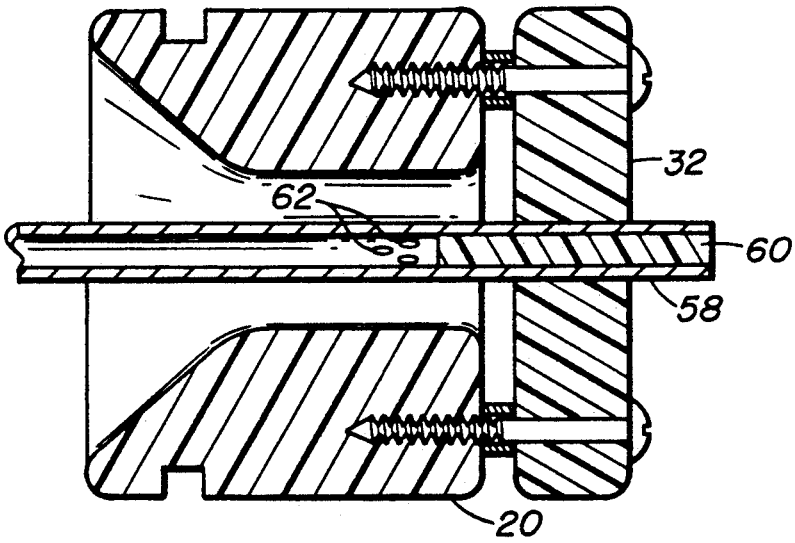
Figure 4C:
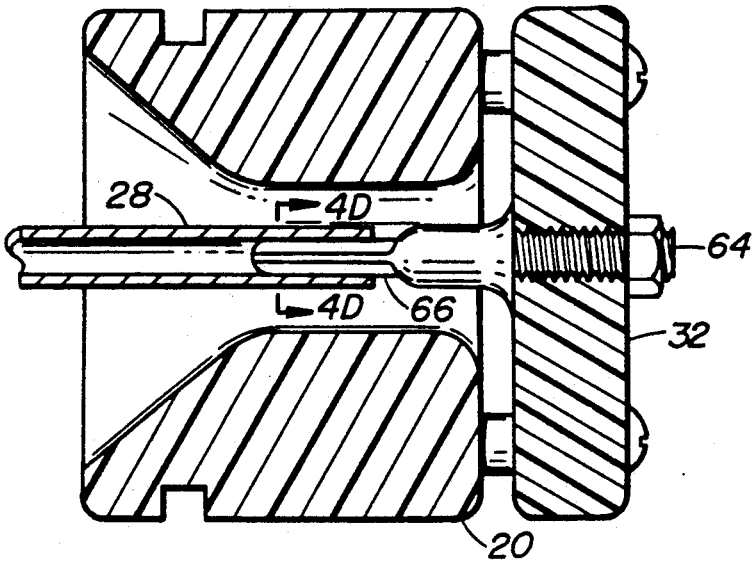

FIGS. 4*a*–4*d* illustrate various other types of aspirator tube supports suitable for use with the cartridge venturi of this invention FIG. 4*a* illustrates a lateral support 56 positioned before (upstream from) the venturi entrance cone 22 (cf. with FIG. 1*a* and 1*b*, which illustrates a lateral support 42 positioned within the entrance cone 22). FIG. 4*b* illustrates an axial support 58 which supports the aspirator tube at or near its end by anchoring it directly into the end piece 32, with a plug 60 filling the terminal segment of the aspirator tube, and causing the aspirated fluid to enter the motive fluid via vents 62. FIG. 4*c* illustrates an axial support 64 which supports the aspirator tube at or near its end by inserting into its end (in telescoping fashion) one side of a separate axial support rod 66 whose other side is anchored in the end piece (and thus the separate support rod extends from the end piece 32 to the inside of the aspirator tube 28). FIG. 4*d* is a cross-sectional view taken along lines 4*d*—4*d* of FIG. 4*c*, and illustrates the fit of axial support rod 66 into aspirator tube 28.

Specifically, the radial diffuser embodiment can employ any of the above support means, and even a lateral means and an axial means simultaneously, while the conical diffuser embodiment (described infra) can use only lateral means. In embodiments where the aspirator tube feeds through an entrance tee, the aspirator tube has the additional support of the small feed-through fitting that carries it into the tee. The lateral type of support means are used only upstream of the aspirator tube opening, where a small amount of interference with the flow has little effect. On the other hand, all support means located downstream from the aspirator tube opening, where turbulence and backpressure would be highly detrimental, are coaxial with the flow and the aspirator tube, and thus present no additional cross-section to the motive flow.

The various aspirator tube supports provide for different aspirator tube outlet geometry. When the lateral support means (e.g., those shown in FIG. 1*a* and FIG. 4*a*) is used alone, the fluid is aspirated out from a hole in the end of the aspirator tube into the center of the motive flow, resulting in a large surface area of contact with the motive flow. This provides a more homogeneous mixing than does introducing the fluid asymmetrically from one side of the throat as many prior art venturis do. In addition, in the radial diffuser embodiment, the fluid coming from the outlet of the axial aspirator tube immediately becomes fanned out on the end piece. When the axial support means of FIG. 4*b* is utilized, the fluid is aspirated from vents in the side of the aspirator tube. When the axial support of FIGS. 4*c* and 4*d* is used, the fluid exiting from the aspirator tube outlet is constrained to flow out around the support rod 66 into the shape of a thin, symmetrical cylindrical sheet centered in the throat, which provides the most optimum mixing of all. Also, of all of the support/aspirator outlet types described, the axial support with the support rod does the best job of avoiding any significant increase in the effective cross-sectional area of the throat in the region of the aspirator tube outlet. In all cases the outlet provides for a symmetrical distribution of the aspirated fluid.

The throat itself can have either parallel or non-parallel walls. I the radial diffuser embodiment the throat is followed by either a thin-sheet diffusion volume, or by a relatively short expansion cone and then a thin-sheet diffusion volume. The thin-sheet volume is a generally disc-shaped volume bounded between two surfaces, whose cross-sectional area at any radius is equal to the gap thickness times the circumference at that point. The first surface of the radially expanding thin-sheet volume is defined by the rear surface of the cartridge body (which can be either generally flat, or concave or convex as described infra), and the second surface is defined by the front surface of the end piece.

The gap or thickness of the thin-sheet diffusion volume can either be fixed, or it can be adjusted by moving the end piece forwards or backwards. In the case of the axial support means of FIG. 4c, depending on the shape and taper of the axial support post 66, this adjustment will also vary the size of the aspirator tube outlet. Additionally, in both embodiments the longitudinal position of the aspirator tube outlet in the throat may optionally be slidably adjustable in and out (even while in operation) in order to position the outlet precisely to optimize suction flow or vacuum, or to adjustably reduce suction flow or vacuum.

Figure 5A:
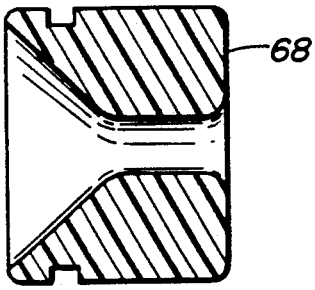
FIGS. 5*a*–5*c* are a series of cross-sectional views illustrating various other possible shapes of the cartridge body rear surface and exit edge for the radial diffuser embodiment of the cartridge venturi of this invention.
Figure 5B:
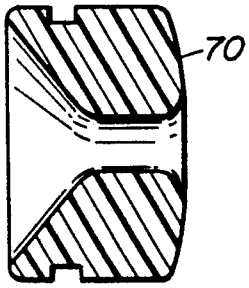
Figure 5C:
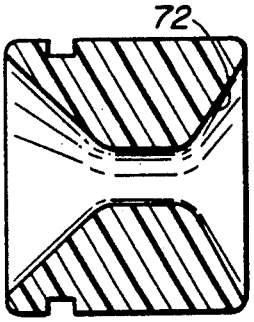

FIGS. 5a–5c are a series of cross-sectional views illustrating various other possible shapes of the cartridge body rear surface and exit edge for the radial diffuser embodiment of the cartridge venturi. FIG. 5a illustrates a generally flat rear surface 68, FIG. 5b illustrates a convex (reverse-tapered) rear surface 70, while FIG. 5c illustrates a concave (conically expanding) rear surface 72.

Figure 6A:
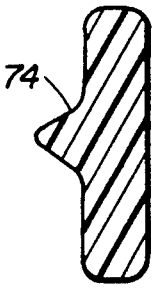
FIGS. 6*a*–6*c* are a series of cross-sectional views illustrating various other possible shapes of the end piece front surface for the radial diffuser.
Figure 6B:
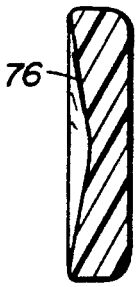
Figure 6C:
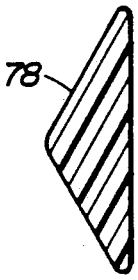

FIG. 6a–6c are a series of cross-sectional views illustrating various other possible shapes of the end piece front surface for the radial diffuser. FIG. 6a illustrates a generally flat front surface with a central mound 74, FIG. 6b illustrates a generally concave front surface 76, while FIG. 6c illustrates a generally convex front surface 78. These, and any other end piece front surface, can be selectively matched to any cartridge body rear surface, as appropriate. The end piece rear surface can similarly be of any shape; flat (as illustrated), curved, or even elongated into a streamlined tear-drop shape.

Figure 7A:
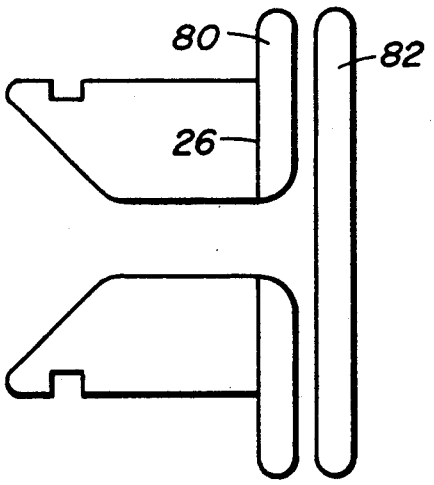
FIG. 7*a* is a cross-sectional view of a relatively larger cartridge body rear surface and end piece front surface for the radial diffuser embodiment of the cartridge venturi of this invention, used to create a diffusion volume of larger outside diameter.

FIG. 7a is a cross-sectional view of a relatively larger cartridge body rear surface and end piece front surface for the radial diffuser embodiment of the cartridge venturi of this invention, used to create a diffusion volume of larger outside diameter. This can be accomplished by the attachment of a generally disc-like plate 80 of larger diameter to the rear surface 26 of the cylindrical body, to be used together with an end piece 82 of approximately the same larger diameter.

Figure 7B:
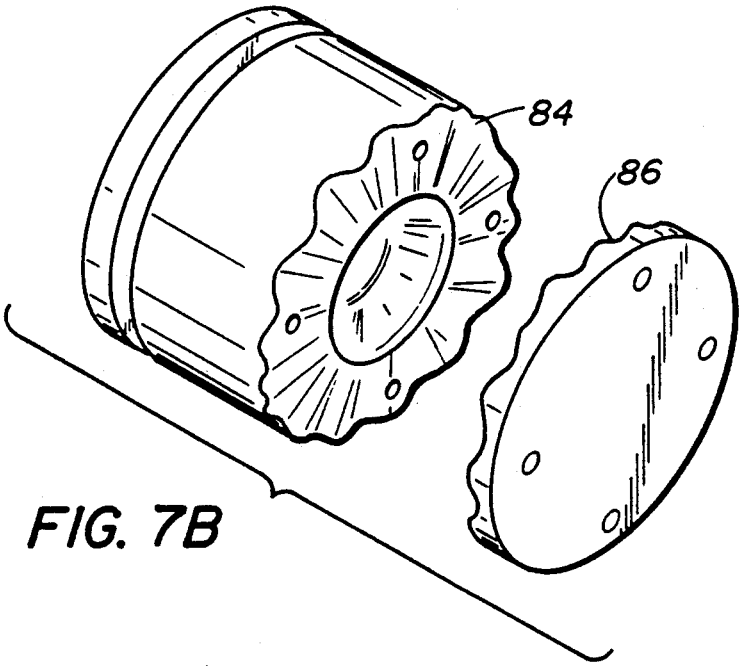
FIG. 7*b* is a perspective view of a modified cartridge body rear surface and corresponding end piece front surface for the radial diffuser, each bearing a scalloped (convolute) surface to increase surface area.

FIG. 7b is a perspective view of a modified cartridge body rear surface and corresponding end piece front surface for the radial diffuser embodiment. This modification incorporates a cartridge body rear surface 84 and end piece front surface 86 bearing mating scalloped radial ridges whose depth increases with diameter to increase the thin-sheet volume faster with radius than normal without widening the gap (which would allow bubble recombination). Alternatively, the rear surface of the cartridge body and/or the front surface of the end piece could have either straight, angled or curved radial channels, ridges or fins. These could be oriented to cause the flow to exit in a spiral or swirling fashion. Furthermore, the end piece could also have one or more holes through it to allow some portion of the flow to exit directly.

Figures 8A, 8B, 8C, 8D:
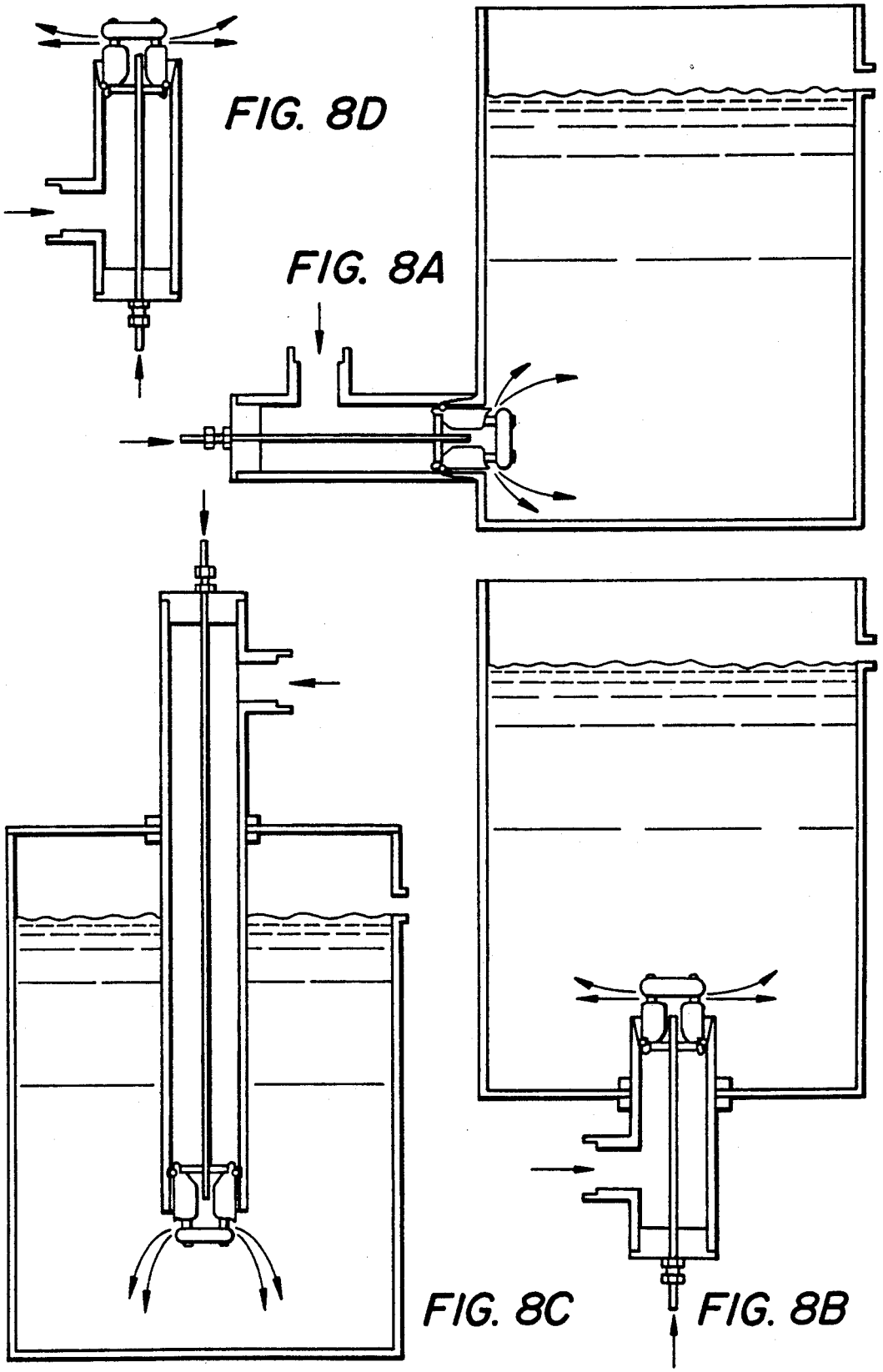
FIGS. 8*a*–8*d* are a series of cross-sectional views illustrating various types of installations for the radial diffuser embodiment of the cartridge venturi of this invention.

FIGS. 8a–8d are a series of cross-sectional views illustrating various types of installations for the radial diffuser embodiment of the cartridge venturi of this invention; FIG. 8a shows the diffuser as installed into the wall of a tank; FIG. 8b shows the diffuser as installed into the bottom of a tank; FIG. 8c shows the diffuser as installed at the end of a pipe extending into a tank; and FIG. 8d shows the diffuser as installed at the end of a pipe and spraying out into the open air. The examples shown in FIGS. 8a, 8b, and 8c are highly suitable for the application of introducing ozone gas into water, where the unique properties of the cartridge venturi are particularly desirable.

In most water ozonation systems it is necessary to include a tank or vessel somewhere after the injection of ozone to serve as a holding volume where the ozone has an opportunity to react with impurities in the water. The radial diffuser embodiment of the present invention is designed to take advantage of direct tank entry. It can control the pattern and direction of exit of the thin sheet into the tank. It is most conveniently installed into the tank wall from the outside of the tank, and thus can quickly be removed from the outside for inspection or cleaning. It lends itself easily to installation at the end of a pipe extending into a tank (FIG. 8c) because it delivers the aspirated fluid coaxially within the same pipe that carries the motive flow (whereas prior art devices would generally require a separate through-tank fitting and tube to carry the aspirated fluid). The ability to enter directly into a tank minimizes backpressure on the venturi. Emerging directly from the venturi into the volume of the tank avoids destruction of ozone on the walls of a pipe and prevents the premature bubble coalescing which occurs when the flow is confined to a pipe. Exiting directly into a tank also causes the ozone to be dispersed over a much larger total volume of liquid, resulting in greater efficiency of solvation and of reaction (oxidation, disinfection, etc.) with the liquid.

When used for aspirating a gas, the radial diffuser embodiment has a thin-sheet diffusion volume consisting of a mixture of motive fluid and aspirated gas which exits as a very fine white homogeneous mist of tiny bubbles. Because of the fineness of the bubbles they not only greatly increase the surface area for absorption and dissolution of aspirated gases such as ozone into the liquid, but they also take a much longer time to rise up through the liquid in the tank, therefore affording a longer contact time, which is a crucial factor in ozone applications.

The diffuser geometry employed in the radial diffuser embodiment also constrains the fluid into a thin sheet in such a way that flow separation from the wall and the resulting turbulence and friction cannot occur. It is important that turbulence be minimized because it not only can destroy ozone, but also makes for inefficient venturi action, requiring more pumping power to do the same job. Furthermore, the ability to insert a cartridge venturi composed of only a small stainless steel ozone aspirator tube and a small amount of Teflon directly into a stainless steel tank saves the expense of the additional stainless steel or Kynar piping and fittings which would be required downstream from the injection of ozone in the case of ultra-pure or drinking water treatment situations. The cartridge venturi also completely avoids any necessity to use an elastomer seal which is inert to the aspirated fluid.

Figure 9:
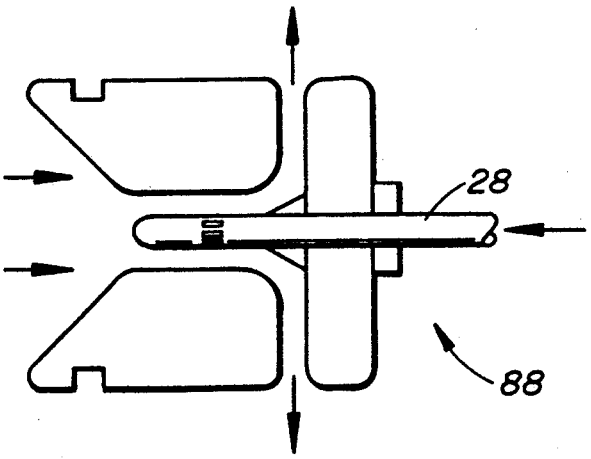
FIG. 9 is a side elevation cross-sectional view of an alternate version of the radial diffuser embodiment of the cartridge venturi of this invention, in which the aspirated fluid enters from the rear of the end piece and feeds in a direction coaxial with but opposite to the flow of motive fluid through the throat.

FIG. 9 is a side elevation cross-sectional view of an alternate opposing-flow version 88 of the radial diffuser embodiment of the cartridge venturi of this invention, in which the aspirated fluid enters from the rear of the end piece and feeds in a direction coaxial with but opposite to the flow of motive fluid through the throat. This will be less convenient in some applications, and more convenient in others since it does not require the use of an entrance tee. This alternate form of the radial diffuser embodiment could easily be used in applications similar to those described above.

Figure 10A:
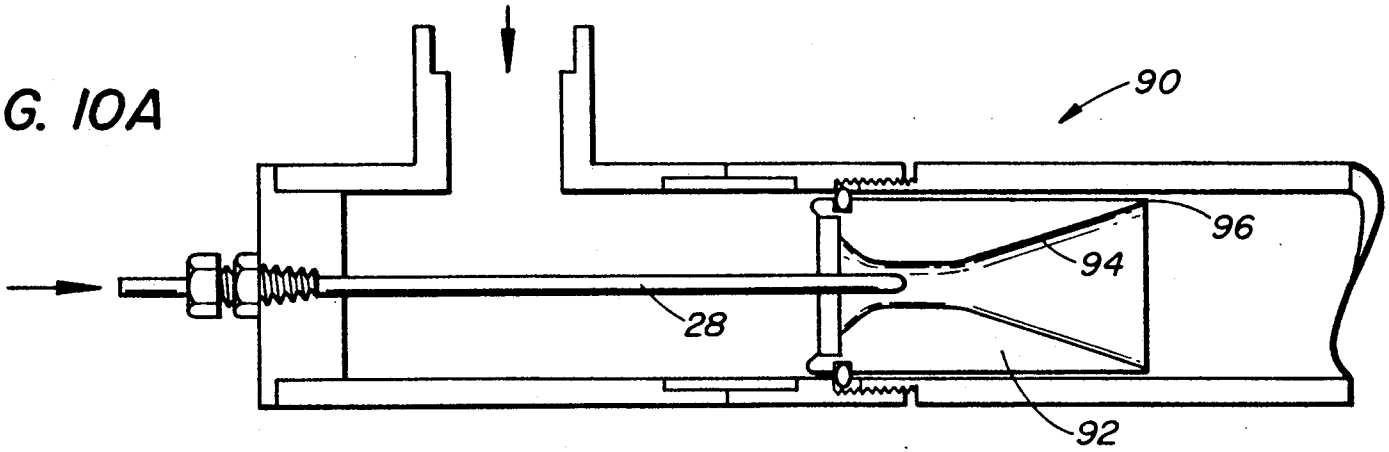
FIGS. 10*a* and 10*b* are side elevation cross-sectional views illustrating the conical diffuser embodiment of the cartridge venturi of this invention, as installed so as to exit into a pipeline or into a tank, respectively.
Figure 10B:
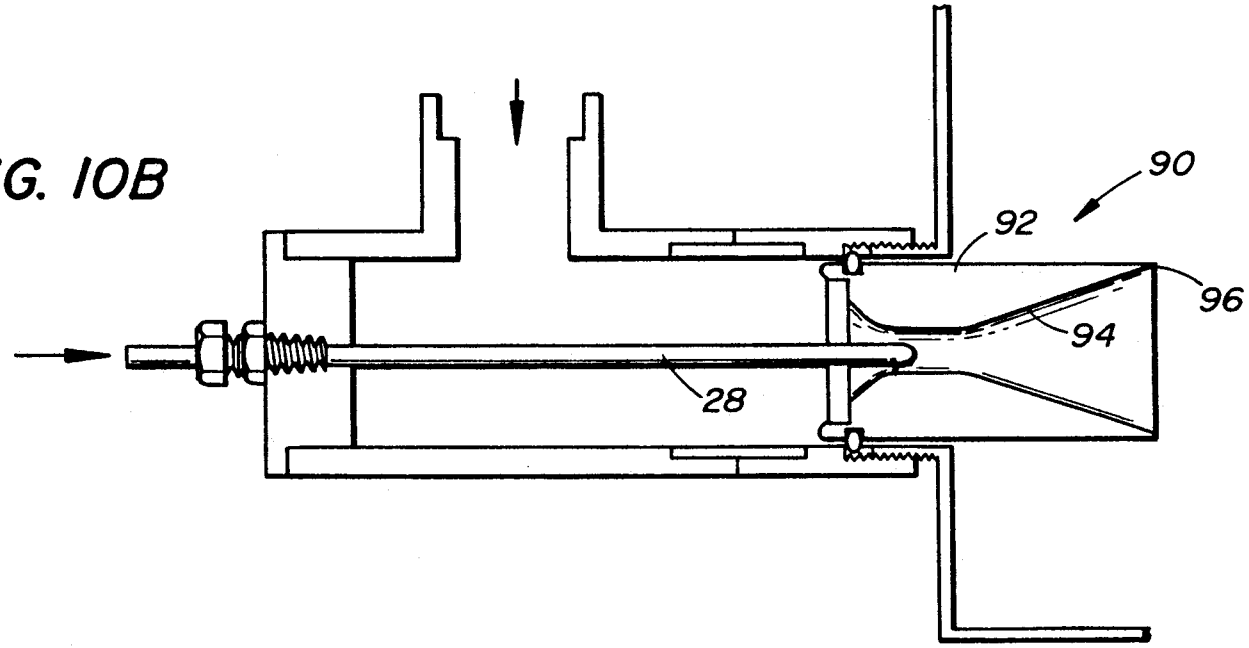

FIGS. 10*a* and 10*b* are cross-sectional views illustrating the conical diffuser embodiment 90 of the cartridge venturi of this invention as installed so as to exit into a pipeline or into a tank, respectively. Instead of using a separate end piece, the cartridge body 92 itself is longer and its rear surface 94 opens into an elongated expansion cone which tapers to a thin edge 96, and the aspirator tube 28 is supported before the throat. This allows it to be installed into and exit into a standard pipeline. In this embodiment, lateral-type aspirator tube support means are used, in addition to the support given by the aspirator tube feed-through fitting in the tee. This conical diffuser embodiment uses more material to fabricate than the radial diffuser embodiment (unless it is moulded) but still uses less material than most prior art because it is in the form of a cartridge.

What is claimed as invention is:

1. A cartridge venturi for aspirating a first fluid into a second fluid, said cartridge venturi conditioned for installation into a pipe carrying said second fluid, said cartridge venturi comprising:

a cartridge body bearing an entrance cone portion, a venturi throat portion, and a rear surface, said venturi throat portion having a longitudinal axis;

an aspirator tube for delivery of said first fluid, said aspirator tube bearing an entry end and a terminal opening, said terminal opening positioned in said venturi throat, said aspirator tube having a longitudinal axis coaxial with said venturi throat portion longitudinal axis; and an end piece bearing a front surface, said end piece front surface positioned proximate said cartridge body rear surface to generally define a disc volume, so that said fluids flow through said venturi throat portion and are directed into a radially flowing thin sheet.

2. The cartridge venturi of claim 1 further including an aspirator tube support member to stabilize said aspirator tube terminal opening.

3. The cartridge venturi of claim 2 wherein said aspirator tube support member comprises a lateral support fixed within said cartridge body.

4. The cartridge venturi of claim 2 wherein said aspirator tube support member comprises a lateral support fixed adjacent said cartridge body.

5. The cartridge venturi of claim 2 wherein said aspirator tube support member comprises an axial support fixed to said end piece.

6. The cartridge venturi of claim 5 wherein said axial support comprises a separate rod member insertable into said aspirator tube terminal opening.

7. The cartridge venturi of claim 2 wherein said aspirator tube entry end is connected to a tube feed-through fitting.

8. The cartridge venturi of claim 2 wherein said aspirator tube terminal opening is adjustably positionable within said venturi throat portion.

9. The cartridge venturi of claim 1 wherein said end piece is adjustably positionable relative to said cartridge body rear surface.

10. The cartridge venturi of claim 1 wherein said end piece is fastened to said cartridge body.

11. The cartridge venturi of claim 1 including retaining means for attaching said cartridge body to said pipe.

12. The cartridge venturi of claim 11 wherein said retaining means comprises a circumferential groove on said cartridge body.

13. The cartridge venturi of claim 11 wherein said retaining means comprises a circumferential flange on said cartridge body.

14. The cartridge venturi of claim 11 wherein said retaining means comprises a threaded cartridge body.

15. The cartridge venturi of claim 1 wherein said cartridge body rear surface is non-planar.

16. The cartridge venturi of claim 1 wherein said end piece front surface is non-planar.

17. The cartridge venturi of claim 1 wherein said cartridge body rear surface and end piece front surface each bear ridges to increase their surface area.

18. The cartridge venturi of claim 1 wherein said aspirator tube delivers said first fluid from a direction coaxial with but opposite to the flow of said second fluid.

* * * * *